US012024685B2

(12) United States Patent
Stephens et al.

(10) Patent No.: US 12,024,685 B2
(45) Date of Patent: Jul. 2, 2024

(54) HIGH PRESSURE ETHANE CRACKING WITH SMALL DIAMETER FURNACE TUBES

(71) Applicant: ExxonMobil Chemical Patents Inc., Baytown, TX (US)

(72) Inventors: George Stephens, Huffman, TX (US); David Spicer, Houston, TX (US); Gregory E. Yeo, Houston, TX (US); Stephen R. Phillips, Katy, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 381 days.

(21) Appl. No.: 17/299,878

(22) PCT Filed: Dec. 13, 2019

(86) PCT No.: PCT/US2019/066117
§ 371 (c)(1),
(2) Date: Jun. 4, 2021

(87) PCT Pub. No.: WO2020/131595
PCT Pub. Date: Jun. 25, 2020

(65) Prior Publication Data

US 2022/0081623 A1 Mar. 17, 2022

Related U.S. Application Data

(60) Provisional application No. 62/782,987, filed on Dec. 20, 2018.

(30) Foreign Application Priority Data

Feb. 18, 2019 (EP) ..... 19157623

(51) Int. Cl.
*C10G 9/20* (2006.01)
*C10G 9/36* (2006.01)

(52) U.S. Cl.
CPC ..... *C10G 9/206* (2013.01); *C10G 9/203* (2013.01); *C10G 9/36* (2013.01);
(Continued)

(58) Field of Classification Search
CPC ..... C10G 9/206; C10G 9/203; C10G 9/36; C10G 2300/1037; C10G 2300/4006;
(Continued)

(56) References Cited

U.S. PATENT DOCUMENTS 4,176,045 A 11/1979 Leftin et al.
4,499,055 A 2/1985 DiNicolantonio et al.
(Continued)

FOREIGN PATENT DOCUMENTS

AU 2748171 10/1972
GB 1298998 12/1972

OTHER PUBLICATIONS

Coke Formation during Pyrolysis: Roles of Residence Time, Reactor Geometry, and Time of Operation. Lyle F. Albright and James C. Marek. Ind. Eng. Chem. Res. 1988, 27, 743-751.
(Continued)

*Primary Examiner* — Randy Boyer
*Assistant Examiner* — Juan C Valencia

(57) ABSTRACT

Systems and methods are provided for performing ethane steam cracking at elevated coil inlet pressures and/or elevated coil outlet pressures in small diameter furnace coils. Instead of performing steam cracking of ethane at a coil outlet pressure of ~22 psig or less (~150 kPa-g or less), the steam cracking of ethane can be performed in small diameter furnace coils at a coil outlet pressure of 30 psig to 75 psig (~200 kPa-g to ~520 kPa-g), or 40 psig to 75 psig (~270 kPa-g to ~520 kPa-g). In order to achieve such higher coil outlet pressures, a correspondingly higher coil inlet pressure
(Continued)

can also be used, such as a pressure of 45 psig (~310 kPa-g) or more, or 50 psig (~340 kPa-g) or more.

19 Claims, 1 Drawing Sheet

(52) U.S. Cl.
CPC ..... *C10G 2300/1037* (2013.01); *C10G 2300/4006* (2013.01); *C10G 2300/4012* (2013.01); *C10G 2300/4031* (2013.01); *C10G 2300/807* (2013.01); *C10G 2400/20* (2013.01)

(58) Field of Classification Search
CPC .... C10G 2300/4012; C10G 2300/4031; C10G 2300/807; C10G 2400/20; C10G 9/20
See application file for complete search history.

(56) References Cited

U.S. PATENT DOCUMENTS

| | | | | |
|---|---|---|---|---|
| 5,990,370 | A | 11/1999 | Sims | |
| 8,431,230 | B2 * | 4/2013 | Takahashi | C21D 9/08 428/328 |
| 10,041,152 | B2 | 8/2018 | Kirchheiner et al. | |
| 2005/0129567 | A1 | 6/2005 | Kirchheiner et al. | |
| 2014/0257001 | A1 | 9/2014 | Spicer et al. | |
| 2016/0376511 | A1 | 12/2016 | Srivastava et al. | |
| 2018/0320088 | A1 * | 11/2018 | Spicer | B01J 19/2415 |
| 2020/0362248 | A1 * | 11/2020 | Cartolano | C10G 11/182 |

OTHER PUBLICATIONS

The Engineering Toolbox (2008). Nozzles. [online] Available at: https://www.engineeringtoolbox.com/nozzles-d_1041.html Accessed on Nov. 29, 2023 (9 pages).
Web page printout titled "Sonic Nozzles" corresponding to https://www.flowsystemsinc.com/sonic-nozzles-and-critical-flow-venturis/. Accessed on Nov. 29, 2023 (2 pages).

* cited by examiner

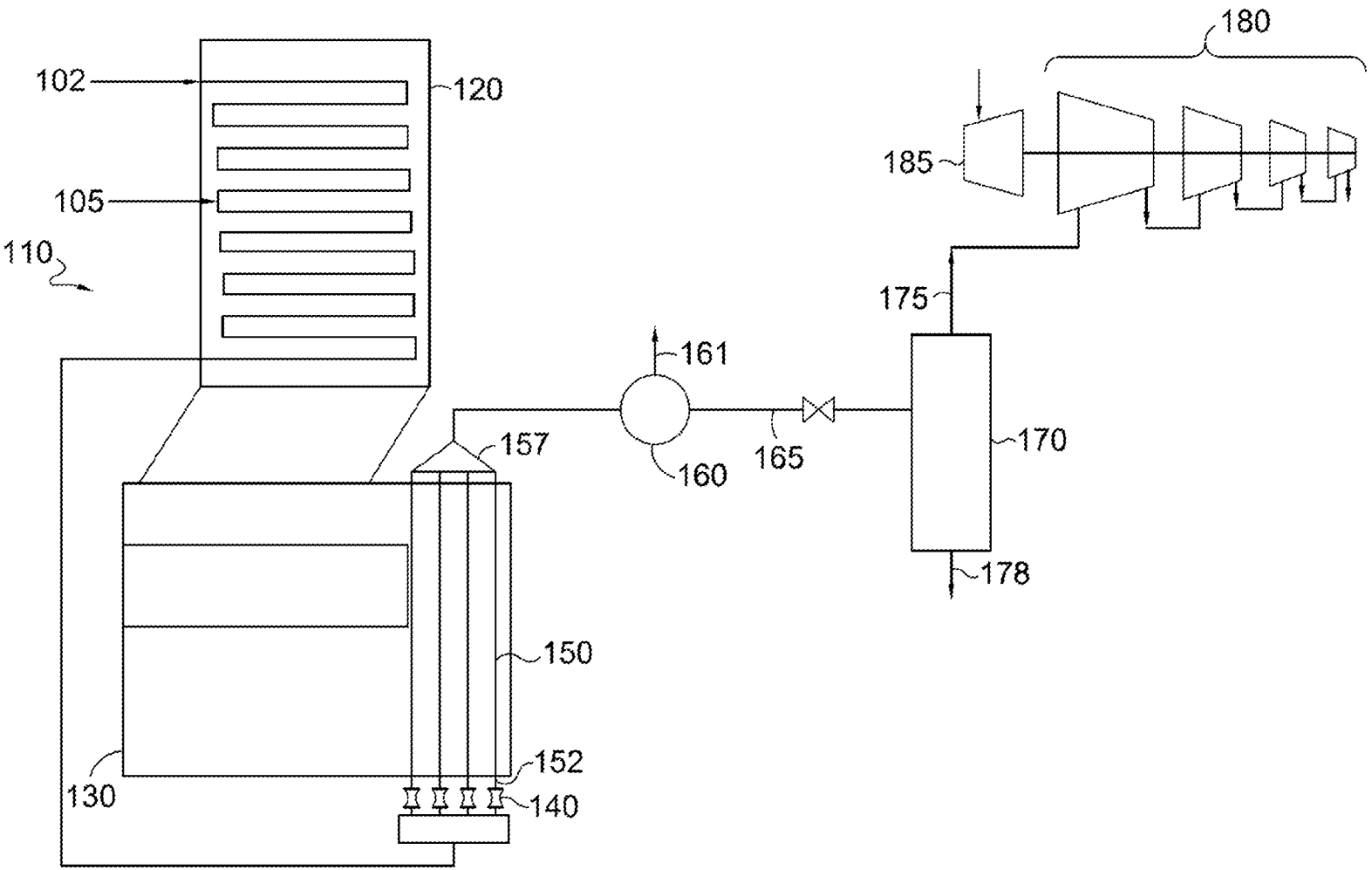
180
185
175
170
178
165
161
160
157
150
152
140
120
102
105
110
130

HIGH PRESSURE ETHANE CRACKING WITH SMALL DIAMETER FURNACE TUBES

CROSS-REFERENCE TO RELATED APPLICATIONS

This application is a US national phase application of PCT Application Serial No. PCT/US2019/066117 having a filing date of Dec. 13, 2019, which claims priority to and the benefit of U.S. Provisional Application No. 62/782,987 having a filing date of Dec. 20, 2018 and European Patent Application No. 19157623.0 having a filing date of Feb. 18, 2019, the disclosures of all of which are incorporated herein by reference in their entireties.

FIELD

Systems and methods are provided for performing ethane cracking at elevated pressures in a steam cracking system using small diameter, low residence furnace coils.

BACKGROUND

Methods of cracking saturated hydrocarbon feedstocks are generally well-known. One example of a cracking process for saturated hydrocarbons is steam cracking of ethane to form ethylene. Performing steam cracking on ethane to form ethylene provides an opportunity to convert a feedstock with relatively low value, such as fuel gas value, to a high value chemical or product, such as a feed for use in polymerization/oligomerization to form larger compounds.

In steam cracking, a hydrocarbon feed is supplied to the convection section of a cracking furnace, preheated and mixed with dilution steam, and further preheated to a temperature at which thermal cracking is about to occur, or is occurring to a slight extent. The mixed feed and dilution steam is then passed to the radiant section of the furnace where cracking to ethylene and other products occurs. It is known in the industry that selectivity for producing ethylene is favored by radiant sections with shorter residence times and/or low hydrocarbon partial pressures. Immediately after exiting the cracking section of the furnace, the effluent is rapidly cooled, generally in heat exchanger which generates high pressure steam. It is also well known in the industry that selectivity to ethylene is favored by very short residence times between the cracking section and cooling to approximately 675° C. After this cooling, the cracked effluent is typically passed through a water quench tower to perform a gross separation so that $H_2$ and $C_1$-$C_4$ hydrocarbons can be separated from the water and naphtha (gasoline) boiling range products in the effluent. A process gas compressor is then used to increase the pressure of the resulting $H_2$ and $C_1$-$C_4$ hydrocarbon stream.

Conventionally, most ethane cracking furnaces have been designed to use larger diameter radiant tubes or coils and relatively low radiant coil outlet pressures to achieve economically attractive ethylene selectivity and methane yields. Such larger diameter radiant tubes can typically have inner diameters of roughly 7 cm to 16 cm. Examples of relatively low radiant coil outlet pressures correspond to outlet pressures of roughly 150 kPa-g or less, with many commercial furnaces operating with coil outlet pressures in the range of from 80 kPa (gauge, "kPa-g") to 90 kPa-g. Such radiant coil outlet pressures correspond to radiant coil inlet pressures of roughly 250 kPa-g or less. Due to this low radiant coil outlet pressure, the resulting inlet or suction pressure for the subsequent process gas compressor is typically 70 kPa-g) or less, e.g., as low as 14 kPa-g).

U.S. Pat. No. 5,990,370 provides an example of a conventional system that operates with low radiant coil outlet pressure. A steam cracking system is described that includes a gas header for accepting both ethane and propane as a feed. The gas header delivers gas feed to various pre-heaters and cracking furnaces. Although an "inlet" pressure in the range of from 2 bar gauge ("barg") to 3 barg (~200 to ~300 kPa-g) is described, this "inlet" pressure refers to the pressure at the beginning of the gas header. Prior to entering the radiant coils, the gas passes through additional structures that reduce the maximum coil inlet pressure. For example, critical flow expansion nozzles are used to maintain an even distribution of gas into the various furnaces/radiant coils, so that any potentially uneven coke formation does not result in flow variance between the furnaces/radiant coils. The ratio of post-nozzle to pre-nozzle pressure is described as being 0.85 or less, in order to ensure uniform distribution of flow. Based on just this structural element, the maximum radiant coil inlet pressure is therefore roughly 2.5 barg (~250 kPa-g) or less. Additionally, due to other pressure drops (such as pressure drop in piping and control valves) further pressure drop would be expected prior to entering the coils. This is illustrated by the examples in the reference, which describe coil inlet pressures of roughly 170 kPa-g or less that are therefore lower than the described "inlet pressure" range of ~200 kPa-g to 300 kPa-g. With regard to coil outlet pressure, the examples describe coil outlet pressures of less than 100 kPa-g.

One difficulty with conventional methods of operating an ethane cracking system is that the low coil outlet pressures result in large capital and process costs for processing of the resulting effluent due to the low gas density and resulting high volumetric flowrates. In order to be suitable for use in subsequent processes, the ethylene-containing portion of the effluent is typically pressurized to 2500 kPa-g or more. Due to the potentially large amounts of non-olefin compounds in the ethylene-containing portion of the effluent, such as paraffins, hydrogen, methane, and/or other diluents, the process gas compressor for pressurizing the effluent can be quite large as well as costly to operate. However, it is known that using higher coil outlet pressures with conventional, larger diameter radiant tubes results in a substantial reduction in ethylene selectivity and an increase in methane yields. It is possible to partially compensate for the elevated methane yields by operating the furnaces at lower conversion/cracking intensity. However, that would result in increased volumes of un-cracked ethane flowing through the recovery train, thus requiring higher investment in supporting equipment such as $C_2$ splitters and refrigeration systems. Thus, the potential cost benefits of operating at higher pressure are substantially lost when attempting to operate conventional, larger diameter tubes at such higher pressures.

Other difficulties with operating at higher coil outlet pressures can be related to increased coking in the furnace coils. For steam crackers designed for cracking of heavier feeds, such as feeds that are liquids at 25° C. and 100 kPa-g, low residence time, smaller diameter radiant tubes are conventionally preferred, such as radiant tubes having an inner diameter of roughly 2.0 cm to 6.0 cm. U.S. Pat. No. 4,499,055 describes an example of such a steam cracking system. Because the thickness of the coke layer developed inside the radiant tubes is generally greater in ethane cracking than in liquid cracking, larger diameter tubes are often selected for ethane cracking service. Unless specifically designed to accommodate the larger coke thickness, smaller diameter tubes may reach limiting pressure drops at lower coke thicknesses and hence exhibit somewhat shorter run-lengths.

It would be desirable to develop additional systems and methods for performing ethane steam cracking that can provide typical industry once-through levels of ethylene selectivity and/or conversion of ethane while reducing or minimizing the costs associated with steam cracking.

U.S. Pat. No. 8,431,230 describes a cast product having an alumina barrier layer. The cast product is described as being for use in a high temperature atmosphere. The cast product is described as having a composition corresponding primarily to Ni and Cr, with a surface barrier layer of $Al_2O_3$.

U.S. Pat. No. 10,041,152 describes a thermostable and corrosion-resistant cast nickel-chromium alloy. The alloy is described as having a high resistance to carburization and oxidation at temperature of 1130° C. or more in a carburizing and oxidizing atmosphere.

SUMMARY

In various aspects, systems and methods are provided for performing steam cracking at elevated coil inlet pressures and/or elevated coil outlet pressures in small diameter furnace coils. In this discussion, such furnace coils can have an inner diameter of 2.0 cm to 6.0 cm. The elevated pressure for performing steam cracking of ethane can be characterized by a coil outlet pressure in the range of about 200 kPa-g to 520 kPa-g (about 30 psig to 75 psig), or (270 kPa-g to 520 kPa-g (about 40 psig to about 75 psig). It has been unexpectedly discovered that higher coil outlet pressures can be used in small diameter furnace coils while maintaining a coking rate comparable to low pressure operation. This can be achieved, for example, by performing the steam cracking at a reduced temperature. Operating with an elevated coil outlet pressure can provide a variety of additional advantages. For example, the amount of subsequent compression needed for further processing of the steam cracking effluent can be reduced, which can reduce the number of stages required in a downstream compressor. More generally, the size and/or number of stages of downstream equipment for handling the steam cracking effluent can be reduced.

Certain aspects of the invention relate to pre-heating a mixture of steam and a feed comprising 50 vol % or more of ethane to a first temperature, and then passing the mixture into a plurality of radiant coils at a coil inlet pressure, wherein each of the furnace coils has an inner diameter of 6.0 cm or less. The mixture is exposed to steam cracking conditions in the plurality of radiant coils to steam cracking, which include a cracking temperature of 800° C. or more and a coil outlet pressure of 200 kPa-g to 520 kPa-g or more for a predetermined residence time to produce a steam cracked effluent. In other aspects, the invention includes (i) increasing the coil outlet pressure from a pressure $P_1 \leq 190$ kPa-g to a pressure $P_2 \geq 200$ kPa-g, (ii) decreasing the cracking temperature, without appreciably increasing the rate of coke accumulation in the furnace coils. Apparatus for carrying out any of the preceding processes are within the scope of the invention.

BRIEF DESCRIPTION OF THE DRAWING

The FIGURE shows an example of a process configuration for performing ethane steam cracking.

DETAILED DESCRIPTION

All numerical values within the detailed description and the claims herein are modified by "about" or "approximately" the indicated value, and take into account experimental error and variations that would be expected by a person having ordinary skill in the art.

In various aspects, systems and methods are provided for performing steam cracking at elevated coil inlet pressures and/or elevated coil outlet pressures in small diameter furnace coils, meaning furnace coils having an inner diameter ≤6.0 cm, e.g., in the range of from 2.0 cm to 5.0 cm, or 3.0 cm to 6.0 cm, or 2.5 cm to 5.0 cm. Instead of performing steam cracking of ethane at a coil outlet pressure of 150 kPa-g or less (~22 psig or less), the steam cracking of ethane can be performed at a coil outlet pressure in the range of from 200 kPa-g to 520 kPa-g (about 30 psig to about 75 psig), or 270 kPa-g to 520 kPa-g (about 40 psig to about 75 psig). Pressures greater than ~520 kPa-g can also be used, but as the pressure is further increased, at some point the selectivity for ethylene formation and/or the amount of methane formation can become uneconomical. Although this higher coil outlet pressure would conventionally be understood to lead to a dramatic increase in coking rate, it has been unexpectedly discovered that higher coil outlet pressures can be used while maintaining a coking rate comparable to low pressure operation. Additionally, operating with an elevated coil outlet pressure can provide a variety of additional advantages. In order to achieve such higher coil outlet pressures, a correspondingly higher coil inlet pressure can also be used, such as a pressure of 310 kPa-g (about 45 psig) or more, or 340 kPa-g (about 50 psig) or more. Such coil inlet pressures are defined herein as the pressure of the feed after passing through any critical flow nozzles and/or other expansion nozzles that are used to maintain substantially even distribution of the feed into the furnace coils.

Conventionally, operating at elevated coil outlet pressure has not been favored during ethane steam cracking due to increased coking rate. It was therefore expected that performing ethane steam cracking with small diameter coils would lead to relatively shorter run-lengths between cleaning/maintenance cycles, resulting at least in part from the low coke thicknesses permitted in typical small-diameter coils. However, it has been discovered that the difficulties with operating at increased coil outlet pressure can be reduced or minimized by taking advantage of the increased gas density and hence lower velocity, to reduce the pressure drop within the furnace coils. At a constant mass flow rate, the velocity of gas within a conduit decreases as the pressure increases (i.e., the volume of a given mass of gas decreases as pressure increases). It has also been found that cracking at higher pressure tends to reduce coking rates because one is able to use a colder temperature within the furnace coils. Because of the increased residence time, a comparable level of once-through conversion rate for ethane and/or ethylene production can be maintained even though a colder temperature is used. In various aspects, the once-through conversion rate for ethane can be 60% or more, or 65% or more, or 70% or more, such as up to 90%. Additionally or alternately, the once-through selectivity for ethylene production, based on the amount of converted ethane, can be 50% or more, or 55% or more, or 60% or more, such as up to 75% selectivity for ethylene or possibly still higher.

It is noted that conventional larger diameter coils do not achieve the same unexpected benefit when ethane steam cracking is performed with elevated coil outlet pressure. Due to the larger diameter of the conventional coils, the residence time of the feed at a given mass flow rate is already substantially larger than the corresponding residence time for a small diameter coil. Increasing coil outlet pressure for conventional larger diameter coils primarily results in a reduced selectivity for ethylene formation and a corresponding increase in selectivity for methane formation. Such a modification in ethylene versus methane selectivity is not desirable.

In addition to operating the furnace coils at a colder temperature, additional features can be used to further mitigate coke production. For example, the cross-over temperature between the pre-heating section of the furnace and the furnace coils can be increased. Increasing the cross-over temperature can reduce the amount of additional energy added within the furnace coils. This can reduce the duty cycle of the radiant section of the furnace (corresponding to the section where the furnace coils are), which can provide a corresponding decrease in coking.

Additional coke mitigation can be provided by using inner surfaces within the furnace coils that are resistant to coke formation and/or are resistant to carburization. Such materials can include, but are not limited to, nickel-chromium alloys that optionally further include an alumina barrier layer. Examples of such materials are described in U.S. Pat. Nos. 8,431,230 10,041,152, which are incorporated by reference herein in their entireties.

By operating at increased coil outlet pressure, a variety of additional advantages can be realized in a steam cracking system. In particular, it would be beneficial from a capital investment and operating efficiency perspective to operate at much higher pressures. For example, the power requirement for a commercial scale process gas compressor can be reduced by 7460 kw (about 10,000 hp) to 22370 kw (about 30,000 hp) by increasing the inlet pressure to the process gas compressor (the "compressor inlet pressure") and/or the furnace coil outlet pressure) from 150 kPa-g (about 22 psig to 310 kPa-g (about 45 psig). Higher operating pressures can also reduce the size of other downstream equipment, such as the water quench tower and various transfer lines/conduits. More generally, it can be beneficial to perform steam cracking under conditions where the coil outlet pressure is sufficiently high so that one or more downstream components, such as the process gas compressor, can operate with an inlet pressure of 270 kPa-g (about 40 psig) or more, or 310 kPa-g (45 psig) or more, e.g., a compressor inlet pressure of 270 kPa-g or more, such as 310 kPa-g or more, or 350 kPa-g or more.

In addition to reducing energy, operating with an increased coil outlet pressure can also reduce the size and/or number of stages for downstream process equipment. For example, when operating with a lower coil outlet pressure, conventional process gas compressor configurations typically require three or more stages, or four or more stages, in order to increase the pressure of the ethylene-containing process gas to a desirable level for further processing. By contrast, when operating with an increased coil outlet pressure, so that the input pressure to the process gas compressor is 270 kPa-g (about 40 psig) or more, or 310 kPa-g (about 45 psig) or more, a reduced number of stages are needed for the process gas compressor. This can correspond to reducing the number of stages in the process gas compressor to have one less stage than a conventional system, or two less stages than a conventional system. As a result, in some aspects, operating at increased coil outlet pressure (and therefore at increased pressure at the process gas compressor inlet) can allow the process gas compressor to have as few as two stages, such as two or three stages, instead of having the four or more stages found in conventional systems. The reduced number of stages results in a substantial reduction in the capital cost of the plant, since each stage is associated with significant amount of additional equipment, such as heat exchangers, separation drums and instrumentation.

In a steam cracking process with a hydrocarbon feed (such as a feed substantially composed of ethane), the hydrocarbon feed is preheated, mixed with dilution steam, and then further preheated to a temperature at which significant thermal cracking is about to commence. For a feed substantially composed of ethane, the temperature at which thermal cracking is about to commence may be in the range of from 675° C. to 730° C. (about 1250° F. to about 1350° F.). For an ethane steam cracker, a feed including 50 vol % or more ethane can be used, or 70 vol % or more, or 90 vol % or more, such as up to having a feed substantially composed of ethane (i.e., more than 99 vol % ethane and up to 100%).

The preheated feed and dilution steam can be passed to the radiant coil of a reactor where thermal cracking to produce olefins occurs. In the radiant or cracking zone of a steam cracking furnace that is operated at a conventional coil outlet pressure of ~150 kPa-g or less, the feed and dilution steam mixture is rapidly heated to high temperatures, such as in the range of 845° C. to 920° C. (about 1550° F. to about 1650° F.) for ethane cracking, to produce the desired product range. During such conventional operation in a small-diameter tube furnace, the residence time of the feed in the radiant or cracking zone can be quite low, such as roughly 0.1 seconds to 0.2 seconds. In a steam cracking system operated with a coil outlet pressure of 200 kPa-g or more, or 270 kPa-g or more, lesser temperatures can be used based on longer residence times for the feed in the radiant section. For a small-diameter tube steam cracking system operated with a coil outlet pressure of 200 kPa-g or more, or 270 kPa-g or more, the residence time for feed in the radiant zone can be 0.1 seconds to 0.3 seconds, with a cracking temperature of 800° C. to 920° C.

In some aspects, the feed substantially composed of ethane can be heated to a higher temperature in order to further reduce or minimize coke formation in the radiant section. Pre-heating the feed to a higher temperature prior to crossover into the radiant section can reduce the amount of heat transfer that is required in the radiant section in order to achieve the desired cracking temperatures. In such aspects, rather than using a crossover temperature in the range of from 675° C. to 730° C. (about 1250° F. to about 1350° F.), a crossover temperature in the range of from 760° C. 775° C. (about 1400° F. to about 1425° F.) can be used. Those skilled in the art will appreciate that an increase in pre-heating zone temperature can lead to a decrease in steam production. This can be offset, if desired, by operating with excess air and/or another diluent such as steam.

Immediately following the radiant zone the mixture is rapidly cooled to quench the thermal cracking reactions. Modern cracking furnace designs recover as much useful energy as possible from the cracked furnace effluent. A typical ethane cracking furnace heat recovery train may include heat exchangers to generate super-high-pressure (SHP) steam, such as steam at 1500 psig (~10.3 MPa-g) or higher, followed by additional heat exchanger(s) to produce steam and/or to preheat high pressure boiler feed water, or furnace feed, or mixtures of furnace feed and dilution steam. The heat recovery train may also include heat exchangers to generate dilution steam from boiler feed water or treated process condensate. Regardless of the heat exchanger train employed, there is a lower limit to the furnace effluent temperature than can be achieved without fouling the heat exchangers in the system. In the case of ethane cracking, furnace effluent is generally not cooled to a temperature less than the range of from 177° C. to 204° C. (about 350° F. to about 400° F.).

The energy input to the furnace is provided by combusting a fuel stream in burners mounted in the radiant section. The hot flue gas generated by the burners is conducted away from the firebox through the convection section and discharged to atmosphere via a flue gas stack.

The FIGURE schematically shows an example of an illustrative steam cracking system. In the FIGURE, a feed 102 substantially composed of ethane is introduced into a convection zone or pre-heating zone 120 of furnace 110. After some pre-heating, the feed 102 is mixed with steam 105 that is injected into pre-heating zone 120 at an intermediate location. Further pre-heating can then occur to raise the temperature of the feed.

After pre-heating, the pre-heated mixture of feed 102 and steam 105 is passed through critical flow nozzles 140 into furnace coils 150 via furnace coil inlets 152. Critical flow nozzles 140 allow for relatively even distribution of the mixture of feed 102 and steam 105 into the various furnace coils 150 independent of small variations in the pressure drop across each furnace coil 150. Furnace coils 150 are located in the radiant zone or cracking zone 130 of heater 110, to facilitate steam cracking within furnace coils 150. After steam cracking, the steam cracked effluent exits from the furnace coils 150 via coil outlets 157. Although four furnace coils are shown in the FIGURE, any convenient number of furnace coils can be used.

After the desired degree of thermal cracking has been achieved, the furnace effluent is rapidly cooled. For this purpose, the furnace effluent is conducted to one or a series of more than one indirect transfer line heat exchanger(s) 160 where the heat energy from the furnace effluent is indirectly transferred to heat water to produce a mixture of water and high pressure steam. The steam is separated from the water in a drum (not shown), and the high pressure steam is conducted away from the drum via conduit 161. This technique is generally favored as the high pressure steam 161 produced may be further superheated and used, for example, to power steam-turbines 185 useful in the process to separate and recover ethylene from the furnace effluent.

The partially cooled furnace effluent leaving heat exchanger 160 is conducted via conduit 165 to a water quench tower 170 or other quenching system that can facilitate separation of the desired ethylene product from at least a portion of the water and/or heavier hydrocarbons present in the partially cooled furnace effluent. The water quench tower can generate an ethylene-containing flow 175 and a quench water product 178 that includes water and heavier hydrocarbons. The ethylene-containing flow can also include unconverted ethane, hydrogen and methane generated during the steam cracking, and other light hydrocarbons such as $C_{4-}$ hydrocarbons. The "water and heavier hydrocarbons" fraction can include naphtha (or higher) boiling range compounds formed during the steam cracking.

The ethylene-containing flow 175 can then be passed into a process gas compressor 180 for compression of the ethylene-containing flow 175 to a desired pressure. The process gas compressor 180 can be powered, for example, by a turbine 185 that is driven by steam that is at least partially generated by heat exchange with the steam cracker effluent, as described above. The number of stages for the process gas compressor 180 can be dependent on the input pressure of the ethylene-containing flow 175. In the configuration shown in the FIGURE, the process gas compressor 180 includes four compression stages.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for performing steam cracking, comprising:

pre-heating a mixture of steam and a feed comprising 50 vol % or more of ethane to a first temperature;

passing the mixture into a plurality of radiant coils at a coil inlet pressure via a plurality of critical flow nozzles, wherein each of the furnace coils has an inner diameter of 6.0 cm or less; and exposing the mixture in the plurality of radiant coils to steam cracking conditions which include a cracking temperature of 800° C. or more and a coil outlet pressure of 200 kPa-g to 520 kPa-g for a residence time to produce a steam cracked effluent.

2. The method of claim 1, wherein the coil outlet pressure is in a range of from 270 kPa-g to 520 kPa-g.

3. The method of claim 1, wherein the residence time is in a range of from 0.1 second to 1.0 second.

4. The method of claim 1, wherein the coil inlet pressure is 310 kPa-g or more.

5. The method of claim 1, wherein the residence time is in a range of from 0.1 to 0.3 seconds.

6. The method of claim 1, wherein the first temperature is 675° C. or more.

7. The method of claim 1, wherein the first temperature is in a range of from 760° C. to 775° C.

8. The method of claim 1, wherein each of the furnace coils has an inner diameter in a range of from 2.5 cm to 5.0 cm.

9. The method of claim 1, wherein each of the furnace coils has substantially the same inner diameter, the inner diameter being in a range of from 3.0 cm to 6.0 cm.

10. The method of claim 1, wherein an inner surface of the radiant coils comprises a coke-resistant inner surface.

11. The method of claim 10, wherein the coke-resistant inner surface is a material selected from the group consisting of a nickel chrome alloy, an alumina barrier layer, or a combination thereof.

12. The method of claim 1, further comprising separating an ethylene-containing fraction from the steam cracked effluent.

13. The method of claim 1, wherein the coil inlet pressure is 340 kPa-g or more.

14. The method of claim 1, wherein the steam cracking conditions further comprise a once-through ethane conversion of 60% or more.

15. The method of claim 1, wherein the steam cracking conditions further comprise an ethylene selectivity, relative to an amount of converted ethane, of 50% or more.

16. The method of claim 1, wherein the cracking temperature is in a range of from 800° C. to 920° C.

17. A system for performing steam cracking, comprising:

a steam cracker furnace comprising a pre-heating section and a radiant section, the radiant section comprising a plurality of radiant coils having an inner diameter ≤6.0 cm, the pre-heating section being in fluid communication with a coil inlet of the plurality of radiant coils via a plurality of critical flow nozzles;

a separation stage, in fluid communication with a coil outlet of the plurality of radiant coils, for separating $H_2$ and $C_1$-$C_4$ hydrocarbons from an effluent generated by the plurality of radiant coils; and a compressor comprising a compressor inlet, a compressor outlet, and three or less compression stages, the separation stage being in fluid communication with the compressor via the compressor inlet.

18. The system of claim 17, wherein the separation stage comprises a water quench tower.

19. The system of claim 17 or 18, wherein the coil outlet of the plurality of radiant coils comprises the effluent generated by the plurality of radiant coils at a pressure in a range of from 270 kPa-g to 520 kPa-g.

* * * * *